United States Patent [19]

Kachur

[11] 4,221,494

[45] Sep. 9, 1980

[54] ROLL-ON APPLICATOR WITH SPRING BAR BALL SUPPORTS

[75] Inventor: Nicholas W. Kachur, Clark, N.J.

[73] Assignee: W. Braun Company, Chicago, Ill.

[21] Appl. No.: 2,854

[22] Filed: Jan. 11, 1979

[51] Int. Cl.[3] ..... B43K 9/00

[52] U.S. Cl. ..... 401/213; 401/214

[58] Field of Search ..... 401/213, 214

[56] References Cited

U.S. PATENT DOCUMENTS

| | | | |
|---|---|---|---|
| 3,095,598 | 7/1963 | Gonnella et al. | 401/214 |
| 3,242,522 | 3/1966 | Jass et al. | 401/213 |
| 4,002,411 | 1/1977 | Harbauer | 401/214 |

FOREIGN PATENT DOCUMENTS

| | | | |
|---|---|---|---|
| 2724099 | 3/1978 | Fed. Rep. of Germany | 401/213 |

*Primary Examiner*—John D. Yasko

*Attorney, Agent, or Firm*—Kegan, Kegan & Berkman

[57] ABSTRACT

A roll-on applicator including a fluid container surmounted by a fitment of a plastic composition and retaining an applicator ball. A closure cap, detachably secured, constitutes a cover for the fitment. With the cap removed and the applicator assembly in a functional, liquid-dispensing attitude, the applicator ball is biased upwardly by a pair of coplanar, horizontally extending, parallel spring bars integrally formed with and spanning the ball-holding fixture, the bars bridging the fixture and supporting the ball to establish an annular fluid flow communicating passage between the applicator surface of the ball and the interior of the dispensing container. When the cap is threadedly secured in place, the cap bears downwardly upon the ball which in turn stresses the spring bars causing them to undergo a limited, temporary, resilient deformation thereby to permit the ball to seat and seal against a sealing band surface of the fitment to establish a fluid-tight engagement therewith, thereby sealing the container to prevent spillage and to obviate evaporation of fluid during periods of storage and non-use.

2 Claims, 6 Drawing Figures

ROLL-ON APPLICATOR WITH SPRING BAR BALL SUPPORTS

BRIEF SUMMARY OF THE INVENTION

This invention is directed to an improved roll-on applicator of the type used to apply a deodorant composition or other liquid preparation to the body. More particularly, the present invention is directed to a ball-type fitment assembly for such applicators for enhanced, controlled transfer of a liquid film from a fluid reservoir to a selected surface.

A principal object of the invention is to provide a structure for more effectively and precisely supporting the applicator ball in a controlled, spaced relationship relative to a reference valving ring so that a reliably reproducible, regulated quantity of the fluid will be dispensed when the applicator is used.

A related object of the invention is to provide a ball applicator support mechanism which is reliably responsive to applied pressure, as effected during threaded engagement of the closure cap, to ensure positive physical displacement of the ball to achieve a uniform and reproducible sealing engagement between the applicator ball and a sealing ring or band, thereby to isolate the fluid contents of the principal container and to prevent leakage when the dispenser is stored in periods of non-use.

Yet another object of the invention is to provide reliable mechanical means for biasing the ball applicator to a position of spaced relationship with respect to a sealing ring, thereby to ensure immediate and repetitively consistent establishment of an annualr fluid flow passage when the cap or closure of the container is removed, so that the fluid applicator may be used effectively for its intended purpose.

Still another object of the invention is to provide a ball applicator supporting assembly constituting a physically substantial mechanical structure which will not be subject to fatigue and to deterioration over extended time periods, and which will reliably position the ball applicator accurately, for use, each time the closure cap is removed from the container assembly.

A general object of the invention is to provide an improved applicator-ball-retaining fitment which is readily attachable to the neck portion of a bottle-like container to transform that container into a highly effective "roll-on" type applicator.

It is an important object of the invention to provide a resilient and flexible applicator-ball-supporting assembly, which will reliably establish a controlled and constant porting to ensure proper and reliable roll-on metering of the liquid product during application.

Another general object of the invention is to provide a ball-holding fixture of a resilient, flexible elastic composition which is sleevedly snapped into secured positive engagement with the collar or neck of the primary container to provide a stable composite assembly.

A related object of the invention is to provide a ball-holding fixture or fitment securable to the neck of a principal container, and which is readily adapted to accommodate any of several different closure caps of various physical heights, contours, and configurations so as to lend aesthetic variability to the package assembly.

A further object of the invention is to provide an applicator-ball-retaining fitment which includes a ball-encircling annular wall provided with internal, radially inwardly directed ball-engaging surfaces selectively operable to establish a container sealing engagement when the container cap is applied, and to provide a controlled annular spacing between the ball and the fitment when the cap is removed, so as to ensure metered application of fluid during use of the "roll-on" applicator.

A related object of the invention is to provide, in a "roll-on" type applicator, a closure cap which engages the upper surface of the ball to apply appropriate pressure to the ball-retaining fitment, upon closure of the cap, so as effectively to establish a fluid-tight seal between the principal cavity of the bottle or container and the applicator ball.

An important object of the invention is to provide an applicator-ball-retaining fitment including resilient ball-supporting elements which will return to a normal, predetermined functional attitude to establish a reproducibly controlled spacing between the ball surface and the fitment when the closure or cap is loosened, thereby to ensure regulated delivery of fluid for applicating purposes.

Other and further objects of the invention, etc. specific nature, and novel features will become apparent from the following detailed description considered in conjunction with the drawings.

BRIEF DESCRIPTION OF THE DRAWINGS

The following drawings are provided as illustrative of preferred embodiments of the invention.

DESCRIPTION OF PREFERRED EMBODIMENTS

Figure 1:
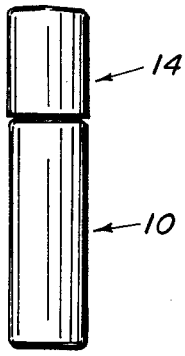
FIG. 1 is a front elevational view of the dispenser of the invention with the closure cap in place.
Figure 2:
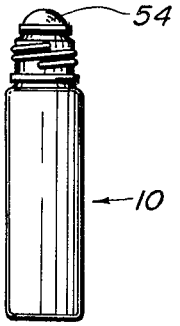
FIG. 2 is a front elevational view of the dispenser with the cap removed.

The aims and objects of the invention are accomplished, in accordance with the present invention, by providing, in a "roll-on" type applicator, an improved ball-retaining fitment readily attachable to the neck of a container and which includes a pair of novel resiliently deformable applicator-ball-supporting spring bars. The spring bars are integrally formed with the fitment and ensure proper spacing between the applicator ball, the ball seat and an annular valving lip to establish a predetermined fluid passage for controlled dispensing of the fluid contents of the container for roller or roll-on application.

Referring now to the drawing, for purposes of disclosure, the improved applicator assembly of the invention is shown embodied in a container 10 of generally cylindrical configuration surmounted by a cap or closure 14. The container 10 terminates at its upper extremity in a reduced diameter neck 16 provided with integrally-formed external screw threads 18 which are complementary to cooperating internal threads 22 formed on the interior of the depending skirt 26 of the closure cap 14. The container 10 itself may be fabricated of glass or of a plastic composition, as by blow molding. The closure cap 14 is preferably molded of a plastic material such as polyolefines. The neck 16 of the container 10 is formed at its upper open end with an annular groove 30 and a surmounting lip or annular rib 32.

A generally cylindrical fitment 40 of a firm but resilient plastic composition is formed at its lower extremity with an inwardly directed annular bead surmounted by a coaxial annular channel-like groove 46, the bead 42 and the groove 46 mating respectively in snap-fit engagement with the cooperating groove 30 and the annular lip 32 of the container 10. The upstanding, generally cylindrical wall 50 of the fitment 40 defines a housing in which an applicator ball 54 fabricated of glass or of hard plastic is confined. The upper end or mouth of the fitment 40 has an internal diameter which is somewhat less than the diameter of the ball 54 so that the ball 54, once forced into the fitment 40 or ball housing, is securely retained. A portion or sector of the ball 50 projects upwardly and out of the fitment to provide an exposed applicator surface 56.

A very important structural component or feature of the improved fitment of the present invention is that it includes a pair of integrally-formed flexible and resilient coplanar, horizontally-extending, parallel, laterally-spaced spring bars or cords 60 and 62 spanning the fitment 40 at a lower portion thereof and serving as a positive but resilient support for the applicator ball 54.

Displaced upwardly of the support spring bars 60 and 62, the fitment 40 includes a valve seat or sealing face, ring, or band 64 which, in the embodiment of the invention depicted comprises an upwardly and outwardly directed, integrally formed annular surface. At its upper extremity, the fitment defines an annular beveled boss or free lip 66 which includes a frustoconical inner surface 68 angled upwardly and inwardly to provide, in conjunction with the opposed annular surface sector 70 of the confined ball 54 a ring-like fluid feed duct 74 which, when the cap is removed from the assembly (FIG. 3), is in fluid communication with the cavity proper of the container 10.

Figure 3:
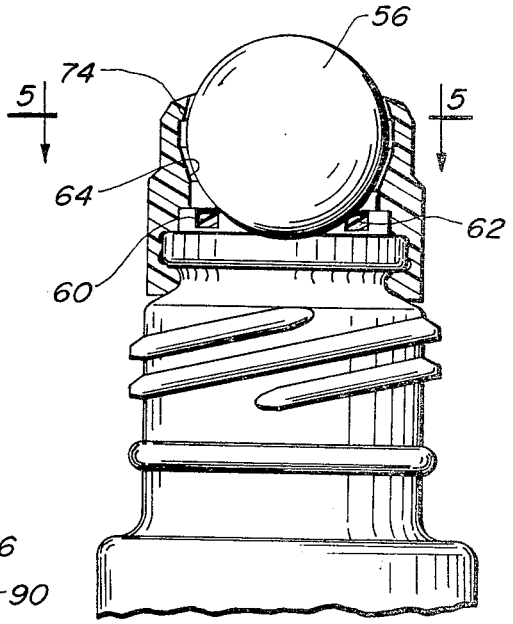
FIG. 3 is an enlarged fragmentary view of the dispenser of the invention showing the collar or neck portion and the attached fitment, the latter in vertical section, the assembly being in its "use" disposition or attitude.

FIG. 3 illustrates the disposition of the applicator ball 54 in the cooperating fitment 40 of the fluid dispenser of the invention when the applicator is ready for use. As clearly shown, the ball-supporting spring bars 60 and 62, which are in their "undeformed" or undistorted state, support the applicator ball 54 at a precise degree of elevation so that the ball surface is free of engagement with the annular valve seat or sealing face 64 to ensure an unrestricted fluid flow from the interior of the container 10 to the regulatory fluid passage 74, when the container is upended. It is an important feature of the improved fitment and ball supporting mechanism of the invention that the ball supporting spring bars 60 and 62 are characterized by remarkable structural integrity, constituting a substantial mechanical support and positioning mechanism for the applicator ball 54 to ensure maintenance of the required critical annular spatial relationship between ball surface 70 and the wiping inner surface 68 of the annular lip 66 of the fitment. The spring bars 60 and 62 are, however, resiliently deformable.

Figure 5:
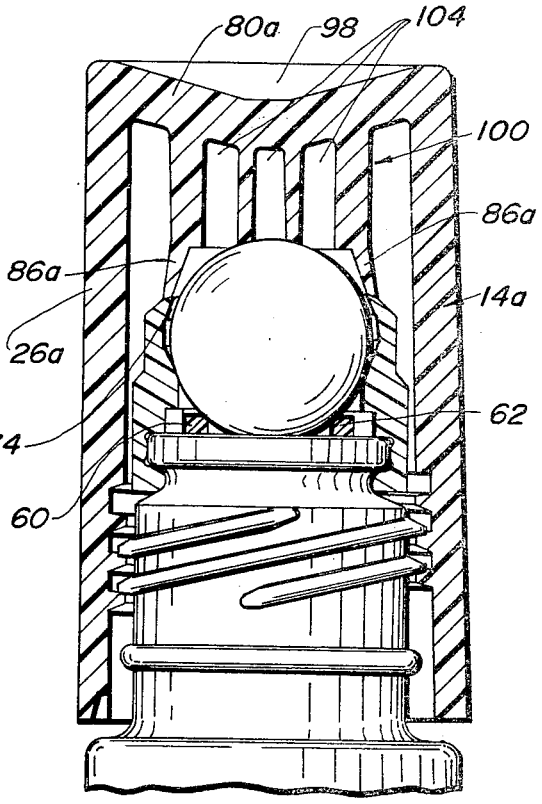
FIG. 5 is an enlarged fragmentary cross-sectional view similar to that of FIG. 4, but with a modified form of closure cap.
Figure 6:
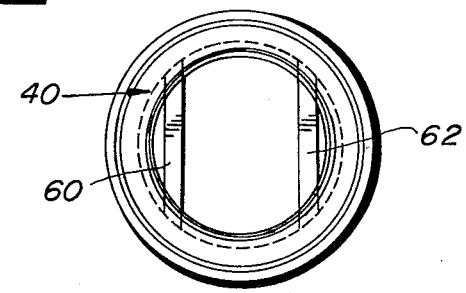
FIG. 6 is a top plan view taken substantially along the lines 6—6 of FIG. 3, with the applicator ball omitted so as more clearly to illustrate the novel ball-supporting spring bars of the invention.

As seen in FIGS. 3 and 5, the relatively wide spacing of the spring bars 60 and 62 facilitates a seating of the ball 54 and centering to stress the two bars 60 and 62 with equal force so that the assembly will maintain a symmetrical, axially-in-line orientation to ensure precise radial centering of the applicator ball 54 in the annular lip 66 of the caging or embracing fitment 40.

Figure 4:
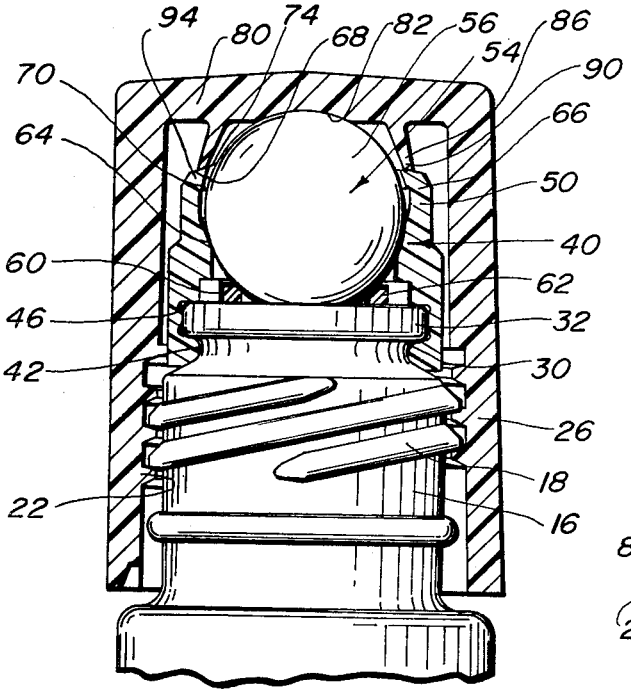
FIG. 4 is an enlarged fragmentary cross-sectional view showing the neck portion of the dispenser, the attached fitment and ball assembly, and the cap or closure in place.

The spatial orientation and disposition of the applicator ball 54 as it establishes a fluid seal for a "not-in-use" condition or attitude of the applicator is shown in FIGS. 4 and 5. Referring first to FIG. 4, the container closure or cap 14 is formed on the under surface 76 of its top wall 80 with a vaulted, dome-shaped, or dished face 82. Integrally formed with and depending downwardly from the under surface 76 of the closure cap 14 is an annular ring 86 which, in the embodiment of the invention shown, tapers downwardly from a thicker to a thinner cross section. The annular ring 86 is formed at its downward extremity with an abutment surface adapted to engage and bear upon a cooperating top surface 94 of the free lip 66 of the fitment 40. Accordingly, when the closure cap 14 is threaded into engagement with the complementary threads 18 of the neck 16 of the container proper, the dish-shaped under surface of the top wall of the cap 14 engages the applicator ball 54, resiliently to displace the spring bars 60 and 62 downwardly to establish a tensioned state. At the same time, the ball is urged into sealing engagement with the annular valve seat or sealing face 64 of the fitment so that the contents of the container are sealed from atmosphere to prevent evaporation or spill. Concurrently, the depending annular ring 86 of the closure cap 14 sealingly engages the cooperating abutment surface 94 at the upper lip 66 of the fitment so as completely to seal the upper surface 56 of the applicator ball to prevent the evaporation of fluids from that surface as well as to prevent the influx of ambient air to the surface 56 of the applicator ball 54. It will be appreciated that the structure described constitutes a relatively simple but most efficient technique for achieving, simultaneously, a positive closure of the container and an isolation of the applicator ball surface so as to ensure its proper operation when the assembly is put to use, even after extended storage periods.

The structure of the ball-retaining fitment 40 and the bottle neck 16 depicted in FIG. 5 corresponds to that previously described with reference to FIG. 4, the differences between the two embodiments being limited to the configuration of the closure cap **14*a*. Specifically, the difference is that the closure cap 14*a* of FIG. 5 is elongated, extending to a somewhat greater height than does the cap 14 of FIG. 4. As shown, the difference has been achieved by extending the height of the cylindrical wall 26*a* in the FIG. 5 embodiment. At the same time, the top wall 80*a* has been depressed inwardly at its central zone to define a crater-like top surface 98. In order to effect positive engagement with the upper surface of the applicator ball 54, the closure cap 14*a* is formed internally with a downwardly depending boss or plug 100. The latter is in turn formed with upwardly projecting cavities 104, opening downwardly, all as clearly shown in FIG. 5. In FIG. 5, those components which correspond to similar components in FIG. 4** have been designated by the suffix "a."

What is claimed is:

1. A liquid dispensing container comprising a hollow body, an externally threaded neck surmounting the body and terminating in a collar defining an opening for dispensing fluid material contained in said body, a cap threaded internally for intercoupling engagement with said threaded neck when affixed thereon as a closure for said container, a generally tubular ball-holding fixture of a resilient, flexible, elastic composition sleevedly secured to the neck of said container, said fixture including an integrally formed circumambient internal annular channel opening radially inwardly and receiving the collar of said neck in snap-in engagement therewithin adjacent a lower open end of said fixture, an applicator ball coaxial with and held in said fixture and projecting beyond an upper open end thereof, an internal annular sealing surface integral with said fixture for engaging a lower hemispheric portion of said ball, said cap being integrally formed with ball-contacting means for abutting an upper hemispheric surface of said ball to urge said ball downwardly to engage and stress said sealing surface upon closure of said container with said cap, resiliently deflectable elastic ball-support means disposed below said sealing surface for engaging an under surface of said ball, said ball support means comprising a pair of coplanar, horizontally extending, parallel, laterally-spaced spring bars integrally formed with and spanning said ball-holding fixture and constituting resiliently deflectable, elastic support cords for said ball resting thereon, said spring bars bridging said fixture at an elevation above said collar of said container, said ball being carried on said support means to assume a position such that a bounding surface of said ball is displaced radially inwardly from said sealing surface to provide an annular fluid flow passage between said ball and said sealing surface when said cap is removed from said container, said spring bars being responsive to downwardly directed ball pressure applied thereagainst during closure of said container with said cap to undergo limited temporary resilient deformation as said ball is urged downwardly to engage and seat against said sealing surface of said fixture in fluid-tight engagement therewith, and said spring bars constituting tensioning means biasing said ball upwardly of said sealing surface to elevate said ball to clear said sealing surface to permit fluid flow between said ball and said surface upon removal of said cap from said container.

2. In a liquid dispensing container including a hollow body, an externally threaded neck surmounting the body and terminating in a collar defining an opening for dispensing fluid material contained in said body, a cap threaded internally for intercoupling engagement with said threaded neck when affixed thereon as a closure for said container, a generally tubular ball-holding fixture of a resilient, flexible, elastic composition sleevedly secured to the neck of said container, said fixture including an integrally formed circumambient internal annular channel opening radially inwardly and receiving the collar of said neck in snap-in engagement therewithin adjacent a lower open end of said fixture, an applicator ball coaxial with and held in said fixture and projecting beyond an upper open end thereof, an internal annular sealing surface integral with said fixture for engaging a lower hemispheric portion of said ball, said cap being integrally formed with ball-contacting means for abutting an upper hemispheric surface of said ball to urge said ball downwardly to engage and stress said sealing surface upon closure of said container with said cap, and resiliently deflectable elastic ball-support means disposed below said sealing surface for engaging an under surface of said ball;

the improvement wherein said ball support means comprises a pair of coplanar, horizontally-extending, parallel, laterally-spaced spring bars integrally formed with and spanning said ball-holding fixture and constituting resiliently deflectable, elastic support cords for said ball resting thereon, said spring bars bridging said fixture at an elevation above said collar of said container, said ball being carried on said support means to assume a position such that a bounding surface of said ball is displaced radially inwardly from said sealing surface to provide an annular fluid flow passage between said ball and said sealing surface when said cap is removed from said container, said spring bars being responsive to downwardly directed ball pressure applied thereagainst during closure of said container with said cap to undergo limited temporary resilient deformation as said ball is urged downwardly to engage and seat against said sealing surface of said fixture in fluid-tight engagement therewith, and wherein said spring bars constitute tensioning means biasing said ball upwardly of said sealing surface to elevate said ball to clear said sealing surface to premit fluid flow between said ball and said surface upon removal of said cap from said container.

* * * * *